United States Patent [19]

Kleiner

[11] Patent Number: 4,790,771

[45] Date of Patent: Dec. 13, 1988

[54] WIRE TRAP TERMINAL

[75] Inventor: Wayne E. Kleiner, Mohrsville, Pa.

[73] Assignee: AMP Incorporated, Harrisburg, Pa.

[21] Appl. No.: 100,042

[22] Filed: Sep. 23, 1987

[51] Int. Cl.[4] ..... H01R 4/24

[52] U.S. Cl. ..... 439/421

[58] Field of Search ..... 439/409, 410, 421, 422

[56] References Cited

U.S. PATENT DOCUMENTS 2,630,468 3/1953 Felts et al. ..... 439/421

4,114,975 9/1978 Weidler .

4,438,997 3/1984 Evans .

*Primary Examiner*—Joseph H. McGlynn

*Attorney, Agent, or Firm*—William B. Noll

[57] ABSTRACT

This invention is directed to a terminal formed from a sheet metal blank and adapted to terminate an insulated wire, where said blank is formed into a housing having a cavity therein as defined by a first opening for receiving said insulated wire, and a second opening through which said wire projects. Attached to said housing at said second opening is a crimping member pivotal from an open to a closed position. The crimping member is characterized by a V-shaped slot having downwardly diverging sharp edge portions for cutting the insulation about said wire. Electrical contact with said wire and pivotal action of said crimping member is effected by the movement of the insulated wire into said first opening to project out of said second opening, followed by a limited reverse movement or withdrawal thereof.

7 Claims, 1 Drawing Sheet

WIRE TRAP TERMINAL

BACKGROUND OF THE INVENTION

1. Field of the Invention

The present invention is directed to a wire terminal for terminating insulated wire, where said termination is effected by the motion of said wire.

2. Prior Art

U.S. Pat. No. 4,199,211 represents one of the more recent developments in the field of wire connectors, where wire gripping means are provided within a housing for engaging a wire inserted into said housing. Within said housing is a wire gripping member which is inclined away from the opening into which the wire is inserted. Said gripping member is characterized by a free end and a secured end about which said member swings, and a V-shaped slot having converging sharp edge portions for cutting the insulation about a wire.

Additional prior art covering wire connector devices of this type are included in the following: U.S. Pat. Nos. RE 26994; 3,093,433; 2,816,193; 2,370,725; and 2,291,434. Each of said patents discloses a connector which includes a cavity within the connector, an opening leading into the cavity and a wire gripping member secured within the cavity for engaging a wire inserted into the cavity through the opening. The wire gripping member is bendably secured to the connector inside the cavity and is normally inclined inwardly away from the opening into the cavity across the path of a wire being inserted through the opening into the cavity. The gripping member upon being struck by the inserted wire yieldably bends away from the path of the wire and as a result of its resiliency the gripping member maintains contact with the wire. Usually the gripping member has a sharp point or free edge which bites into the surface of the inserted wire upon an outward tug being applied to the wire after its insertion into the connector cavity.

The present invention represents a simplified construction for a terminal housing, and to a more effective means to achieve termination of the wire within said housing. Such construction and means can be appreciated from the following description, particularly when read in conjunction with the several drawings.

SUMMARY OF THE INVENTION

Figure 1:
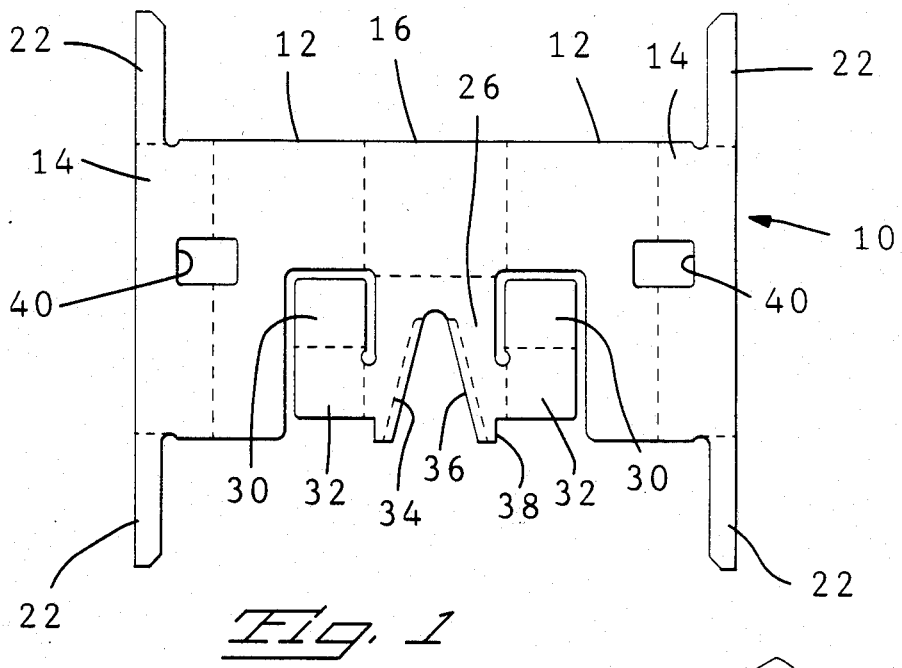
FIG. 1 is a top plan view of a sheet metal form from which the terminal housing of this invention may be fabricated.

The present invention is directed to a terminal formed from a sheet metal blank and adapted to terminate an insulated wire. The blank, illustrated in FIG. 1, is formed into a housing having a cavity therein as defined by a first opening for receiving said insulated wire, and a second opening through which said wire projects. Attached to said housing at said second opening is a crimping member pivotal from an open to a closed position. The crimping member is characterized by a V-shaped slot having downwardly diverging sharp edge portions for cutting the insulation about said wire and achieve electrical contact with the wire. Electrical contact with said wire and pivotal motion of said crimping member is effected by initially moving the insulated wire into said first opening a sufficient distance so that the wire projects out of said second opening. With the insulation lodged within said slot, the wire is withdrawn a slight distance which causes the crimping member to pivot into a locked position, while at the same time, cutting into the insulation. If desired, provision is made for an insulated cap to be placed over said terminal housing.

DETAILED DESCRIPTION OF PREFERRED EMBODIMENT

Figure 2:
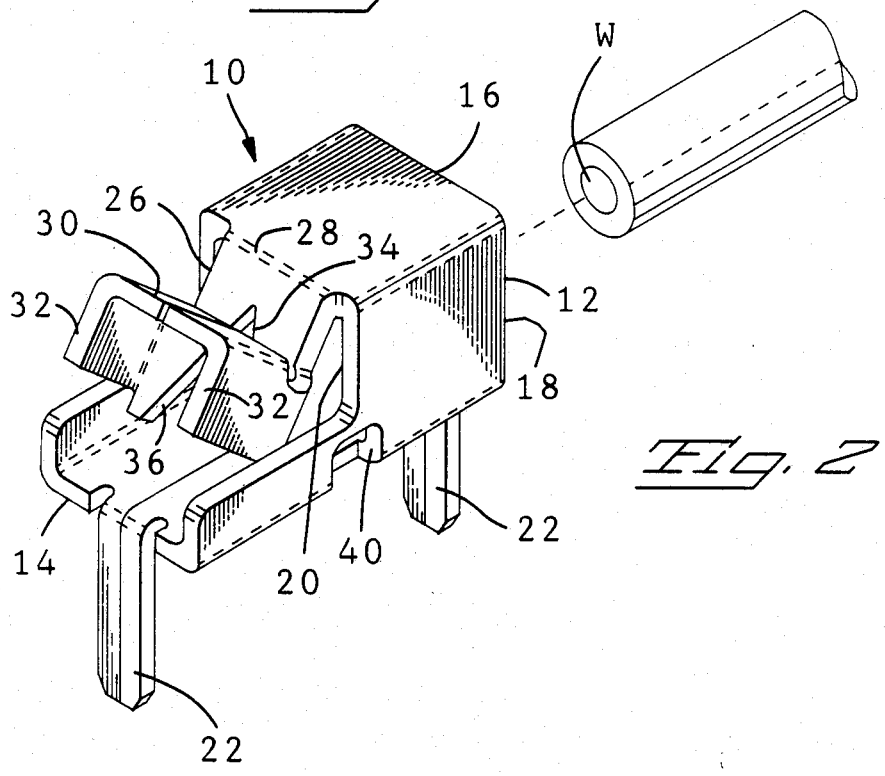
FIG. 2 is a perspective view of the wire terminal of this invention, illustrating a wire in the preinsertion position.

Referring now to the drawings, in particular FIG. 1, there is shown a blank stamped from an electrically conductive sheet metal, such as copper or an alloy thereof, which blank may be fabricated into the wire terminal illustrated in FIG. 2.

The wire terminal 10 of this invention comprises a housing having a pair of side walls 12, a base 14, and a limited top portion 16. These housing portions define a first opening 18, into which the wire to be terminated is inserted, and a second opening 20. Projecting from the base 14 are a pair of terminal posts 22 which may be inserted into a mounting board 24.

Attached to the top portion 16, adjacent the second opening 20, is a V-slotted crimping member 26. Said crimping member 26 is adapted to pivot from the open position (FIGS. 2 and 3) to the closed position (FIG. 4). The pivot point 28 can be created in the sheet metal blank through coining the sheet metal in the stamping process at a location between the top portion 16 and crimping member 26. This will create a weakened pivot point 28 such that the crimping member may be moved as desired.

Figure 3:
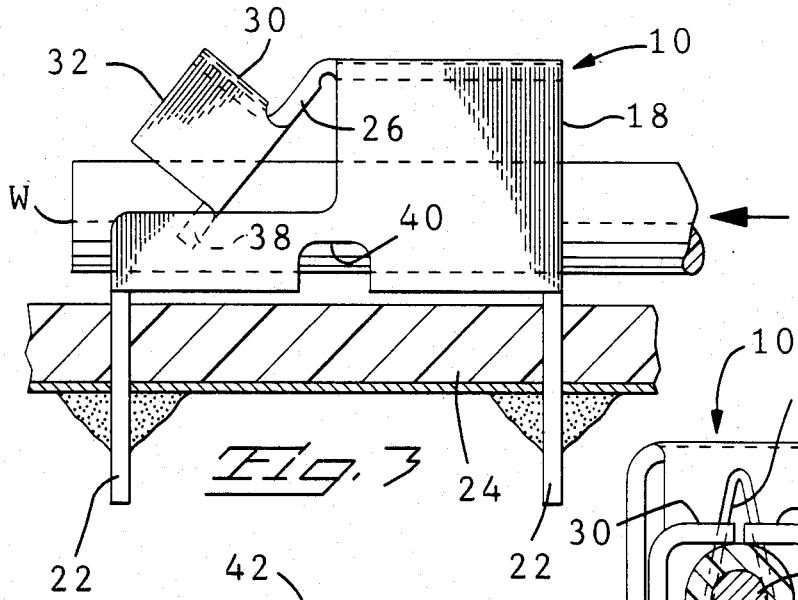
FIG. 3 is a side elevation of the wire terminal of FIG. 1, illustrating a wire in the fully inserted position prior to the partial withdrawal thereof.
Figure 5:
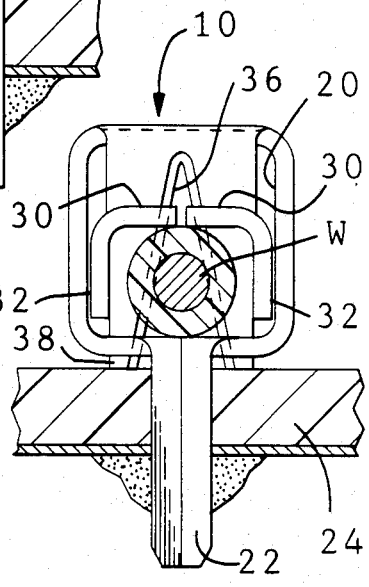
FIG. 5 is an end view of the wire terminal shown in FIG. 4.
Figure 4:
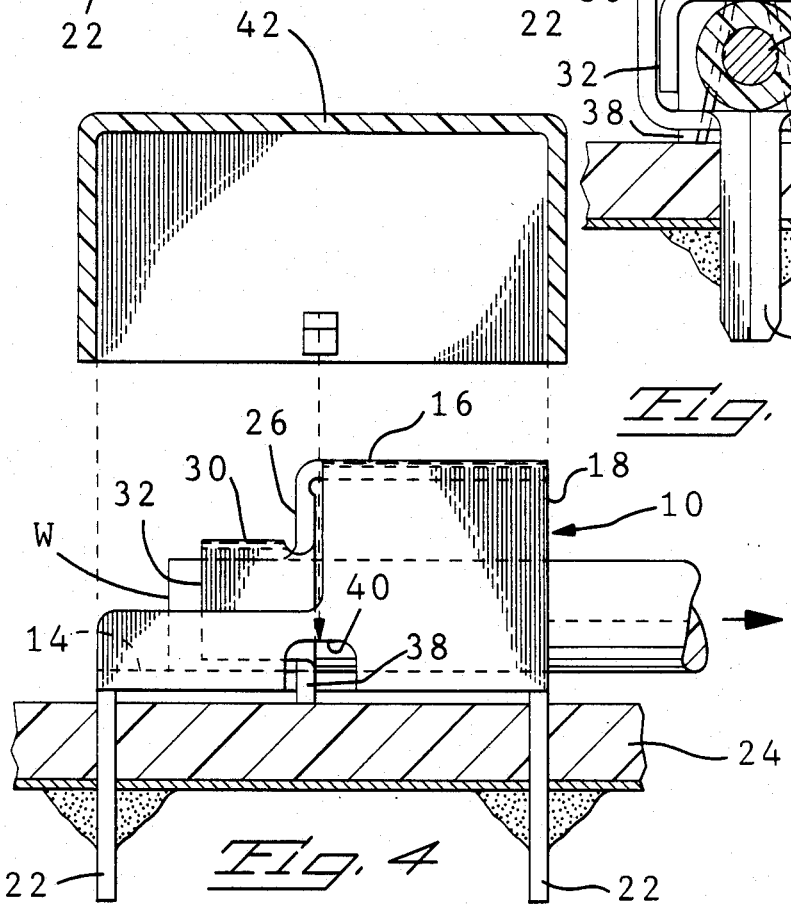
FIG. 4 is a side elevation similar to FIG. 3 but illustrating the terminated and locked position for the wire.

The crimping member 26, as best seen in FIGS. 2 and 3, consists of a wire insulation support portion or top 30, side walls 32, and a rear V-slotted portion 34. The legs of the V-slotted portion 34 diverge downwardly in a direction away from the pivot point 28. The edges 36 are sharpened so that when the wire is urged thereagainst such edges cut into the wire's insulation, thus bringing the V-slotted portion 34 into electrical contact with the wire W. This latter feature may best be seen in FIG. 5.

In operation, the wire W, with insulation thereabout, is inserted into the terminal housing 10 through first opening 18 where the wire slides under the sharp V-slotted portion 34. Since such portion is angled in the direction of wire insertion, the V-slotted portion 34 pivots away at a shallow angle only riding on the upper surface of the wire as it travels into the housing.

At some point of desired maximum insertion, see FIG. 3, the wire is pulled in a reverse direction against the sharpened edges 36 which catch the insulation. As the wire is further withdrawn, the crimping member 26 begins to pivot downwardly cutting further into said insulation until it reaches the 90 degree dead center position shown in FIG. 4. At this position, the insulation support or top 30 pushes down to squeeze the insulation against the base 14 providing a definite movement stop point. At this stop point, side projections 38 snap into openings 40 located at the junction of the sidewalls 12 and base 14.

In the event it is desired to place a protective cover 42 (FIG. 4) over the terminal housing, the openings 40 may be used as an undercut surface in which to snap such cover 42.

The wire terminal of this invention is ideally suited for terminating thin wires which have a tendency to bend laterally when pushed into a restricted orifice.

I claim:

1. A wire trap terminal for terminating an insulated electrical wire, where said terminal is provided with leads projecting therefrom for connection to an electrical circuit, said terminal comprising:

a housing having a cavity therein as defined by a first opening for receiving an insulated wire, and a second opening through which said wire projects, a crimping member pivotal from an open to a closed position and attached to said housing at said second opening, where said member is provided with a V-shaped slot capable of cutting said insulation, and means for locking said crimping member against movement in said closed position.

2. The wire trap terminal according to claim 1 wherein in the closed position said insulation has been cut sufficiently to bring said slot into electrical contact with said wire.

3. The wire trap terminal according to claim 1 wherein said housing is characterized by a pair of side walls, each having a slot therein, and that said locking means comprises opposing tab projections on said crimping member for engagement with said slots.

4. The wire trap terminal according to claim 2 wherein the force to pivot said crimping member is derived by the movement of said insulated wire into said housing followed by the limited withdrawal thereof.

5. The wire trap terminal according to claim 3 including an insulated cover adapted to substantially enclose said housing.

6. The wire trap terminal according to claim 5 wherein tab means are provided on said cover for engagement with said housing slots.

7. The wire trap terminal according to claim 1 wherein said housing is stamped from a flat sheet of metal.

* * * * *